United States Patent [19]

Worrell

[11] Patent Number: 4,795,066

[45] Date of Patent: Jan. 3, 1989

[54] LADLE NOZZLE INSERT

[75] Inventor: Richard A. Worrell, Apple Valley, Calif.

[73] Assignee: Kaiser Steel Corporation, Oakland, Calif.

[21] Appl. No.: 422,022

[22] Filed: Sep. 23, 1982

[51] Int. Cl.[4] ..... B22D 41/00

[52] U.S. Cl. ..... 222/590; 222/600

[58] Field of Search ..... 222/590, 591, 600, 597; 220/307

[56] References Cited

U.S. PATENT DOCUMENTS

| | | | |
|---|---|---|---|
| 3,197,824 | 8/1965 | Dolenic et al. . | |
| 3,201,837 | 8/1965 | Sylvester | 222/590 X |
| 3,279,003 | 10/1966 | Yates . | |
| 3,484,026 | 12/1969 | Zehnder | 222/600 |
| 3,511,261 | 5/1970 | Bick et al. | 137/315 |
| 3,779,742 | 12/1973 | Fehling et al. | 75/46 |
| 3,944,116 | 3/1976 | Danieli | 222/590 |
| 3,960,546 | 6/1976 | Rote et al. | 75/60 |
| 4,043,798 | 8/1977 | Nashiwa et al. | 75/53 |
| 4,165,065 | 8/1979 | Bowden | 266/44 |
| 4,174,962 | 11/1979 | Frantzieb, Sr. et al. | 75/53 |
| 4,175,918 | 11/1979 | Frantzreb, Sr. | 428/567 |
| 4,286,773 | 9/1981 | Kristiansen et al. | 266/44 |

FOREIGN PATENT DOCUMENTS

| | | | |
|---|---|---|---|
| 2247303 | 5/1975 | France . | |
| 1581058 | 12/1980 | United Kingdom | 222/590 |

OTHER PUBLICATIONS

International Publication WO80/01659, published 8-2-1-80, Jan O. Kristiansen et al.

*Primary Examiner*—J. Joseph Rolla

*Attorney, Agent, or Firm*—Burns, Doane Swecker & Mathis

[57] ABSTRACT

An elongated steel tube, adapted to be filled with a high fusion temperature sand is positioned in a stationary refractory nozzle and its supporting refractory bore of a steel pouring ladle bottom nozzle before molten steel is first poured from a steel making furnace into a refractory-lined pouring ladle and then subsequently poured through said nozzle under the control of a slide gate or a stopper valve either directly into a steel ingot mold or through an intermediate tundish into a continuous caster. The steel tube includes centering means, such as fingers, secured to the outside of the tube to substantially center the tube in the refractory nozzle and permit additional sand to be placed in the annular space between the nozzle bore and the sand tube. In this way, upon opening the bottom valve, the hydrostatic head of molten metal assures quick, full flow of molten metal, such as finished steel through the nozzle insert. Such flow promptly and positively clears the nozzle for controlled pouring of the metal.

1 Claim, 2 Drawing Sheets

LADLE NOZZLE INSERT

FIELD OF THE INVENTION

The present invention relates to molten steel pouring ladle nozzles. More particularly, it relates to a nozzle insert for steel pouring ladled wherein a tubular container of sand may be positioned so that when a bottom valve is opened to release molten steel from a bottom nozzle of a pouring ladle, molten metal flow is full and instantaneous.

It is a particular object of the invention to assure quick, full flow through a steel pouring ladle bottom nozzle controlled by a slide gate or a stopper valve by positioning an elongated steel tube, adapted to be filled with a high fusion temperature sand, in the stationary refractory nozzle and its supporting refractory bore before molten steel is first poured from a steel making furnace into the refractory-lined pouring ladle and then subsequently poured either directly into a steel ingot mold or through an intermediate tundish into a continuous caster. The steel tube includes centering means, such as fingers, secured to the outside of the tube to substantially center the tube in the refractory nozzle and permit additional sand to be placed in the annular space between the nozzle bore and the sand tube. In this way, upon opening the bottom valve, the hydrostatic head of molten metal promptly flows through the nozzle insert and clears the nozzle for controlled pouring of the molten metal.

BACKGROUND OF THE INVENTION

In steel making furnaces, including electric, basic oxygen process, or open hearth process, finished molten steel is normally transferred to a pouring ladle. Such ladles are generally supported by trunions or pivots and carried by an overhead crane to pour molten metal into individual ingot molds or into strand-casting equipment for continuous casting. For pouring molten steel from the ladle at a controlled rate, it has long been common practice to pour through a bottom nozzle, toward which the bottom of the ladle is normally tipped. Flow through the nozzle is controlled either by an internal stopper or an external slide gate. Due to maintenance and repair problems, particularly when the ladle is used as a holding vessel for continuous casting, external slide gate arrangements have now largely replaced the internal stopper system in most large ladles. Generally, the stopper requires replacement after each pour. Additionally, full shut-off of metal flow may be difficult to obtain where the stopper and actuating rod are immersed in molten metal during prolonged pours. Further, it is desireable not to cool the ladle significantly between pours. In a typical ladle slide gate, a movable nozzle in the gate portion is aligned with the stationary ladle nozzle in the ladle bottom for pouring through it.

While bottom slide gates significantly simplify nozzle and ladle construction, at the end of each pour the refractory gate plate, including the immoveable nozzle carried by it, must be inspected and usually replaced. This normally requires the vessel to be tipped and rested on its side for ready access. After inspection or replacement, the gate may be closed and the vessel returned to its erect position. In such righting of the ladle, portions of metal, refractory spallings, or slag remaining in the ladle may fall into the bottom stationary nozzle. Such material in the stationary nozzle frequently interferes with free flow of liquid metal when the ladle is loaded and the slide gate opened to pour the charge. Since such ladles hold on the order of 50 to 100 tons of molten steel, visual inspection of the nozzles after filling is not practical so that there is no way to assure full, quick flow of metal when the gate is opened. Further, after the vessel is returned to an erect position the stationary nozzle portion is normally filled with sand to protect the refractory materials of the stationary nozzle and the gate covering it while the vessel is being filled and moved to a pouring position. Where inadvertently the nozzle is partially plugged with pieces of steel, slag or the like, before sand is added or the sand is damp (or includes clay material), the sand body impedes full, quick flow, rather than aid in starting such casting flow, either for strand-casting (continuous casting) or into individual ingot molds. Such ladles are also known as metal holding vessels since they may be used for teeming molten steel into a continuous casting arrangement, such as an intermediate holding vessel, called a tundish.

Where flow does not begin, the nozzle must be "lanced" or poked to begin flow. While it is sometimes possible to open the vessel nozzle with an oxygen lance such as where a basic oxygen process lance is available, added oxygen may seriously deteriorate the finished steel or damage the walls of the ladle. At times, even with mechanical poking of the nozzle no opening can be obtained, resulting in complete loss of the melt at a cost of several thousand dollars. Further, in mold pouring equipment where a shroud is used between the pouring nozzle and the mold to prevent degradation of the steel by air exposure, mechanical access may not even be possible. Thus, any failure to flow is catastrophic to the entire vessel contents.

SUMMARY OF THE INVENTION

In accordance with the present invention, the problems of opening a pouring vessel or ladle for full, quick flow are overcome by providing a tubular insert adapted to contain sand which will not fuse at molten steel temperatures within the stationary ladle pour nozzle. The tubular sand insert includes centering and retaining spring fingers adjacent one end of the tubular member to engage the bore of the refractory nozzle. Desirably, the tubular member prior to insertion includes removable caps on each end which functionally engage the tube side walls to hold sand in the tube until it is inserted. The tube is inserted through a "spectacle" opening, or moveable nozzle, in the slide gate and into the stationary nozzle. Before such insertion, the cap at the upper end of the tube is removed. With the vessel in an upright position as in nozzles using a stopper arrangement, the tube displaces any loose steel or slag particles that may have fallen into the nozzle or the support bore. In a side resting position, as in use with a slide gate, insertion of the the tube prevents such particles from falling into the nozzle. To assure that the nozzle and bore remain clear, the length of the tube exceeds the length of the nozzle and extends up into the vessel a few inches. With a slide gate, the bottom cap is removed just before the closure plate of the slide gate covers the stationary nozzle and seals the lower end of the "sand tube". In practice, with either a stopper or slide gate closure, the annular space between the sand tube and the nozzle bore is then filled with refractory sand. As noted, desirably in the case of a slide gate closure the elongated tube extends up into the ladle or vessel for a few inches and the steel walls of the tube are exposed for several inches above the nozzle bore. In this way, when molten steel is transferred to the ladle, the exposed upper end of the sand tube may melt into the molten steel. In application to a stopper valve closure the end of the tube is covered until the stopper is lifted. In either application, the tube side wall is desirably formed of a low melting point steel. In this way, upon opening the bottom valve to pour molten steel, the refractory sand in the sand tube freely flows out under the pressure head of molten steel. During full flow, the balance of the relatively thin steel tube wall melts in the molten steel. This thereby releases the spring fingers and the anuular body of sand in the nozzle. The result is a clean full flow of molten metal from the ladle the moment the slide gate is opened, and at the end of the pour a clear nozzle is available to receive another sand tube insert for the next pour. The sand in and around the tube pours into the slag portion of the casting.

Various other objects and advantages of the present invention will become apparent to those skilled in the art from the following detailed description of the preferred embodiments taken in conjunction with the accompanying drawings which form an integral part of the present specification.

DESCRIPTION OF THE PREFERRED EMBODIMENTS

Figure 1:
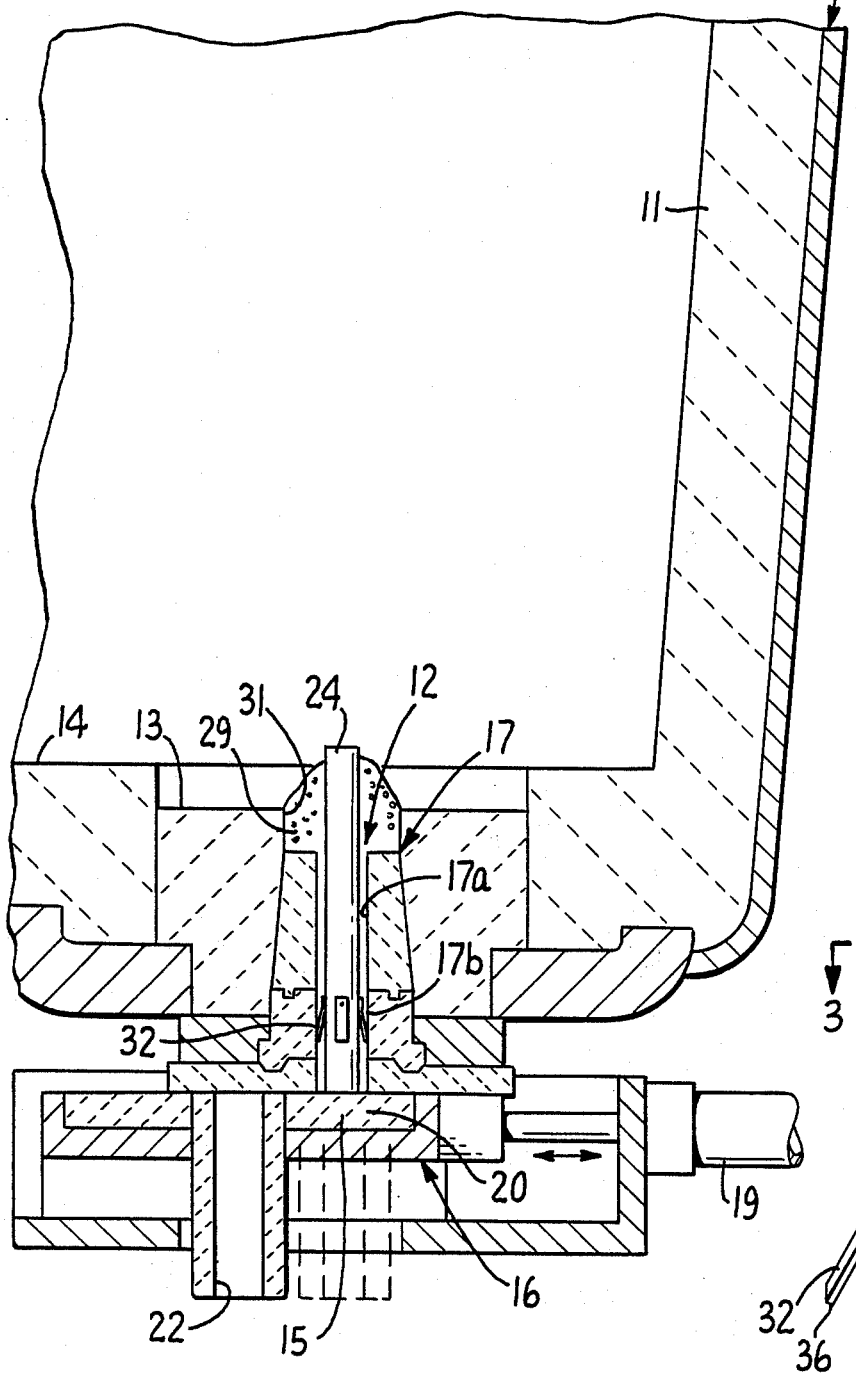
FIG. 1 is a vertical elevation view, partially in cross-section of a molten metal pouring vessel having a bottom nozzle controlled by a slide gate and in which a sand tube constructed in accordance with the present invention has been inserted into the nozzle prior to filling the vessel.

Referring now to the drawing, FIG. 1 shows the present invention in a steel pouring ladle or holding vessel 10, which includes a bottom pour nozzle bore 12 in ladle bottom 14. Bore 12 is controlled by a slide gate arrangement 16. As indicated gate arrangement 16 includes a gate member 18 which has a refractory plate forming a blind portion 20 and a moveable nozzle portion 22. When closed as indicated in FIG. 1, blind portion 20 of refractory plate covers nozzle bore 12. When actuated, as by hydraulic or pneumatic operator 34, moveable nozzle portion 22 registers with stationary nozzle 24 in bore 12 to permit molten metal to flow. U.S. Pat. Nos. 3,480,186 and 3,352,465 disclose typical slide gates for such ladle nozzle control. U.S. Pat. No. 3,430,644 discloses a rotary gate arrangement for a pouring vessel that may include multiple and different-sized nozzles to which the present invention is also applicable.

In the embodiment of FIG. 1, the interior of vessel 10 is lined with refractory material 11 and nozzle bore 12 includes a well block 13 enclosing a nozzle assembly 17 which includes an upper nozzle 17*a* and a lower nozzle 17*b*. The two nozzles define the flow path for molten metal from ladle 10. Because nozzle bore 12 is long and tubular, debris in the form of metal spallings, slag, or other material can easily fall into the bore between pours of molten metal or while the open top vessel is being moved as by an overhead crane to receive a charge of molten metal. Such debris can seriously delay flow of metal when gate 16 is actuated to register bore 22 with nozzle bore 12. Further, even if bore 12 is cleaned and inspected prior to filling of vessel 10, slag or pieces of metal may fall into the bore before it is filled with sand. This will prevent full flow and require that such sand body be "lanced" from within the vessel or poked, as by a rod from outside. Frequently, neither method will work and the entire charge of molten metal must be returned to the furnace or otherwise dumped. Such a loss of a multiple ton load of finished steel is a financial disaster costing several thousand dollars.

Figure 2:
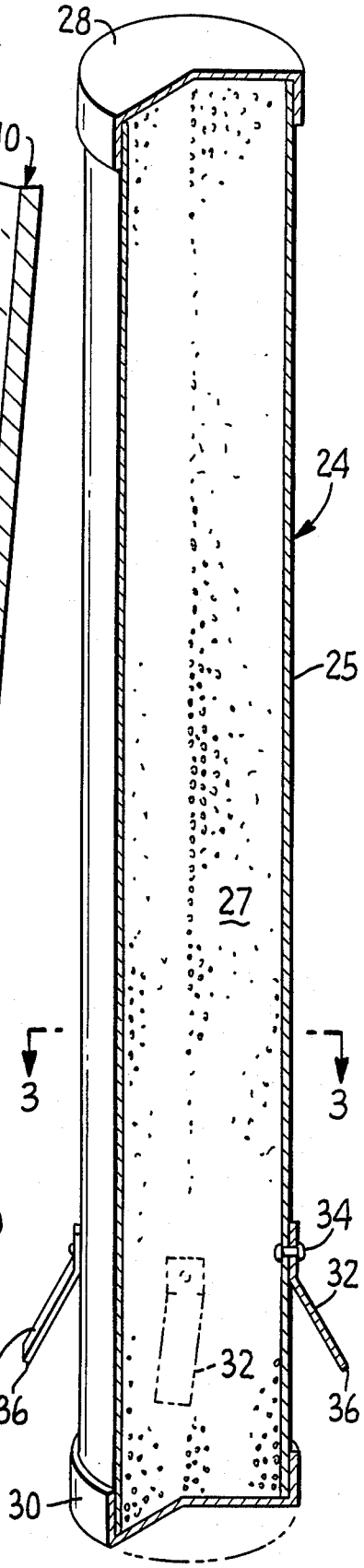
FIG. 2 is an enlarged vertical elevation view, partially in cross-section of the sand tube installed in the ladle of FIG. 1.
Figure 3:
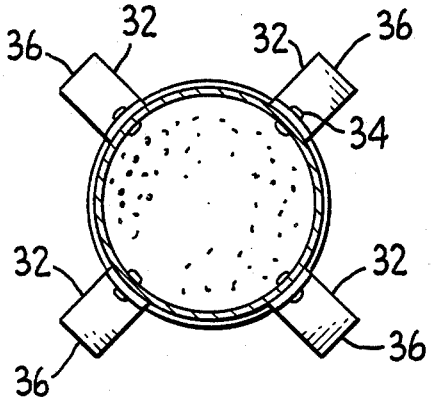
FIG. 3 is a cross-sectional plan view through the sand tube of FIG. 2 taken in the direction of arrows 3—3.
Figure 4:
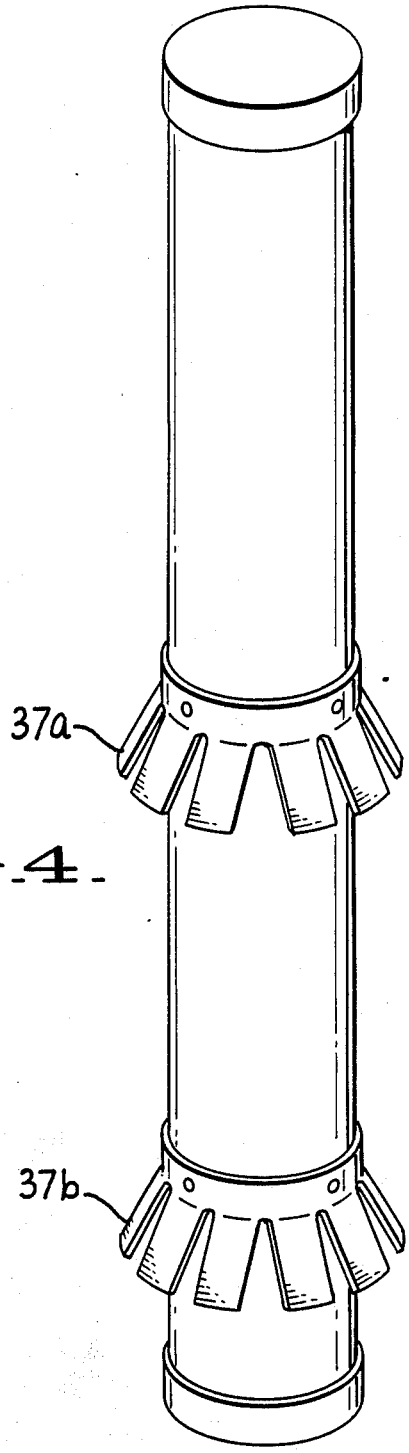
FIG. 4 is a perspective view of an alternate spring arrangement for holding a sand tube in a ladle nozzle.
Figure 5:
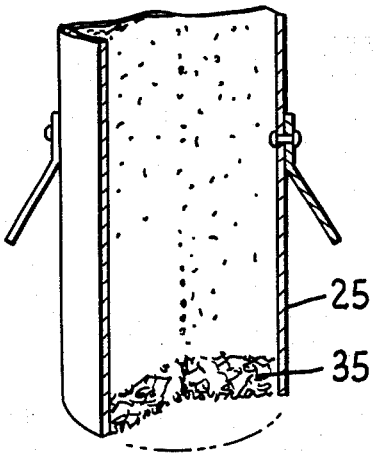
FIG. 5 is a cross-sectional elevation view similar to FIG. 2 illustrating an alternate bottom closure for the sand tube.

In accordance with the present invention, sand tube 24, best seen in FIGS. 2 and 3 prevents such losses, and is readily inserted in bore 12 during preparation of the ladle to receive a charge. Tube 24 is generally a cylindrical tube 25 formed of a relatively low melting steel sheet which may be rolled and welded. It may also be crimped and soldered, riveted or formed of seamless stock, as by drawing. Desirably, tube 25 is sufficiently stiff, so that if necessary, when filled with sand 27, having a high fusion temperature, (substantially higher than molten steel, e.g. 3000° F.), the tube may be used to physically dislodge any material in bore 21. Desirably, both ends of tube 25 are provided with friction fit caps 28 and 30, respectively, at the upper and lower ends. Further, as shown in FIG. 1 the diameter of tube 24 is such that there is clearance between tube sidewall 25 and bore 12 when installed in the ladle nozzle. This permits refractory sand to be poured around tube 24 after it is seated generally in the center of bore 12 by spring fingers 32. Fingers 32 are secured as by rivets 34 at radially spaced apart positions, such as the four indicated in FIGS. 2 and 3. Other centering means, such a pair of collars 37*a* and 37*b*, shown in FIG. 4, may be used to position tube 24 properly in bore 12. Desirably, but not necessarily, as indicated in FIG. 5, a pad 35 of steel wool, or the like, may be used as a bottom plug to temporarily retain sand 27 in tube 24, with or without cap 30 which is normally removed before insertion into bore 21.

FIG. 1 indicates the positioning of sand tube 24 in stationary nozzles 17*a* and 17*b*. For such installation, with gate 18 in a position so that moveable nozzle 22 aligns with nozzles 17*a* and 17*b* tube 24 is thrust into the indicated location. Desirably, upper cap 28 is first removed so that only refractory sand 27 obstructs flow therethrough when lower cap 30 is removed. As indicated the length of tube 24 is such that the upper end extends up into ladle 10 and above refractory lining 11 for about three inches. The tube is held generally centrally in nozzles 17*a* and 17*b* by spring fingers 32 bearing outwardly on the sidewalls of the nozzles. Bottom cap 30 may then be removed. If steel wool pad or plug 35 is used, prior to filling tube 24 with sand 27, such cap may be removed before insertion into the bore of nozzle 19. Gate 18 is shut immediately after removal of cap 30 or plug 35 to retain sand 27 in tube 24. Although sand 27 may be tamped in tube 24, depending upon its diameter, only a small amount of such sand is normally lost during the period between removal of plug 35 or cap 30 and closure of gate 18. In any event, subsequent filling of the annular space between tube 24 and the nozzle bores will replace any lost sand.

With blind 20 of gate 18 in the position shown, additional refractory sand 29 may be poured around tube 24 into the annular space within nozzles 17*a* and 17*b* and upwardly into bore 31 of well block 13. Preferably the sand also rises around a part of tube 24 extending above bottom 14 of ladle 10, but does not fully cover the exposed portion of the tube sidewall.

For operation, when molten metal is transferred into vessel 10 from a steel making furnace such exposed upper end of tube desirably melts in the molten steel. Thus, upon actuation of gate 18, the hydrostatic head of molten metal above the column of sand 27 promptly forces the entire charge of sand through tube 24 and through the open bore of moveable nozzle 22. As the metal is poured, sidewall 25 of tube 24 becomes heated to the temperature of the flowing metal and likewise melts into the pour and passes into the casting mold. Such action also removes the remaining sand around tube 24 and spring fingers 32 so that at the end of the pour, the entire bore is cleared and ready for loading another full flow sand tube 24.

In practice of the present invention, it is important that sand used to fill tube 24 be free-flowing at molten steel temperatures. For such service, so-called "zirconium" sands, normally available as a refractory material in and around steel making facilities, are satisfactory. Desirably they are sufficiently dry so that preheating of the ladle does not result in sand grains adhering to each other. Small amounts of clay materials, normally found with most natural sands, including "cleaned" sand can result in such adherance in the presence of small amounts of moisture.

Although tube 24 is preferably steel, other metals or materials which will retain their structural form at elevated temperatures, such as aluminum, may be used.

As described above, the present invention has been particularly disclosed in a ladle having a bottom nozzle closed by a slide gate arrangement. The sand tube is of great value in such a system because of the volumes of such ladles or holding vessels. However, the invention is equally applicable in stopper closed nozzles, still in wide use in portions of the steel making, shaping and treating industry where smaller ladles are the rule. In such a system, the stopper element formed of a refractory material is raised and lowered by a rod extending down through the ladle. The operating rod is protected from the molten metal by refractory sleeves. The rod and attached stopper are raised by a mechanical linkage mounted on the side and over the rim of the ladle. A typical installation is shown and described at pages 527 and 528 in "The Making, Shaping and Treating of Steel", Ninth Edition, Copyright 1971, published by United States Steel Corporation, Pittsburg, Pa.

As noted above, the stopper head is seated in the ladle nozzle well to close off the nozzle. In such an installation the sand tube is desirably seated in the nozzle either before or after the stopper head is seated and the end of the head may directly contact the upper end of the tube. If desired the balance of the stopper well may be filled with refractory sand after the head is seated. The lower end of the sand tube in such an application is either closed by a plug as in FIG. 4 on the bottom cap left on the tube until the stopper is lifted to begin the pour. The cap may either be knocked off simultaneously with opening the nozzle or the friction fit between cap and tube arranged to cause the molten metal pressure head to drive the refractory sand with sufficient force to automatically displace the cap.

While only a few embodiments of the present invention have been described, various modifications or changes will become apparent to those skilled in the art of steel making without departing from the concept of the invention. All such modifications and changes coming within the scope of the claims are intended to be included therein.

I claim:

1. A method for improving flow of molten steel from a bottom pouring steel ladle nozzle upon opening of a slide gate closing said nozzle which comprises the steps of forming a nozzle insert of a tubular member with a lower cap, filling the insert with granular material which is free flowing at temperatures in excess of the temperature of the molten steel in said ladle, said tubular member having a thickness to permit melting thereof upon contact with said molten steel in said ladle, inserting said nozzle insert into a ladle nozzle so that the upper end of said insert extends beyond the nozzle into the ladle, removing said lower cap and promptly closing said gate to retain said sand in said nozzle insert, filling the annular space between said tubular member and said nozzle with additional sand and packing additional sand around said tubular member above said nozzle but below the upper portion of said tubular extending member into said ladle, filling the ladle with molten metal, having the molten metal in said ladle liquify said extended portion of said tubular member, then opening said gate to release said sand in said tubular member with the pour of molten metal from said ladle and thereby permit the remainder of said tubular member to melt into the flowing metal and the balance of the sand in said nozzle to flow out with said flowing metal and thereby leave a clean nozzle at the end of said pour.

* * * * *